US007631743B2

(12) United States Patent
Takai et al.

(10) Patent No.: US 7,631,743 B2
(45) Date of Patent: Dec. 15, 2009

(54) APPARATUS AND A METHOD FOR PROCESSING PAPER CURRENCY

(75) Inventors: Tomoyo Takai, Owariasahi (JP); Yuji Nagaya, Seto (JP)

(73) Assignee: Hitachi-Omron Terminal Solutions, Corp., Tokyo (JP)

( * ) Notice: Subject to any disclaimer, the term of this patent is extended or adjusted under 35 U.S.C. 154(b) by 202 days.

(21) Appl. No.: 11/439,952

(22) Filed: May 25, 2006

(65) Prior Publication Data

US 2007/0007103 A1 Jan. 11, 2007

(30) Foreign Application Priority Data

Jul. 6, 2005 (JP) ..... 2005-197761

(51) Int. Cl.
*G07F 7/04* (2006.01)
*G07D 7/16* (2006.01)
*G07D 7/20* (2006.01)

(52) U.S. Cl. ..... 194/206; 382/112; 382/135

(58) Field of Classification Search ..... 194/205, 194/206, 302; 902/16, 17, 41; 382/112, 382/135; 493/409–412; 53/468.52, 381.5, 53/381.6, 381.7, 382.1
See application file for complete search history.

(56) References Cited

U.S. PATENT DOCUMENTS

| | | | | |
|---|---|---|---|---|
| 4,623,975 | A * | 11/1986 | Kagami | 356/638 |
| 5,147,274 | A * | 9/1992 | Mandel | 493/409 |
| 5,265,856 | A | 11/1993 | Walker | |
| 5,895,904 | A * | 4/1999 | Nissim | 235/380 |
| 6,186,307 | B1 * | 2/2001 | Mukai | 194/206 |
| 6,595,060 | B2 | 7/2003 | Wunderer et al. | |
| 6,896,117 | B2 * | 5/2005 | Nomura | 194/213 |
| 6,994,201 | B2 * | 2/2006 | Yu et al. | 194/207 |
| 7,131,539 | B2 * | 11/2006 | Mukai | 209/534 |
| 2004/0012144 | A1 | 1/2004 | Matzig et al. | |
| 2004/0256196 | A1 | 12/2004 | Yu et al. | |

FOREIGN PATENT DOCUMENTS

| | | |
|---|---|---|
| EP | 1 011 079 | 6/2000 |
| EP | 1 160 737 | 12/2001 |
| JP | 07-014048 | 1/1995 |
| JP | 2003-288628 | 10/2003 |
| JP | 2004-168489 | 6/2004 |
| NL | 7707606 | 1/1978 |
| WO | WO 2004/022465 | 3/2004 |

OTHER PUBLICATIONS

Chinese office action of App. No. 200610105452.1 dated Oct. 24, 2008.

* cited by examiner

*Primary Examiner*—Patrick Mackey
*Assistant Examiner*—Mark Beauchaine
(74) *Attorney, Agent, or Firm*—Antonelli, Terry, Stout & Kraus, LLP.

(57) ABSTRACT

Paper currency is conveyed to a resend area 522 when deposited paper currency is folded paper currency, wherein a front corner thereof, relative to the direction of conveyance, is folded, based on information that is read in from a sensor unit 530*a*. In the resend area 522, the folded location is up. The folded paper currency is resent within the resend area 522. The action of the conveying rollers 551 and 552 corrects the fold of the paper currency within the resend area 522.

18 Claims, 15 Drawing Sheets

Counterfeit/torn state

Counterfeit/torn state

Large fold state

Forward small fold state

Reverse small fold state

Fig.6

582

| | |
|---|---|
| First bill | Forward small fold state |
| Second bill | Large fold state |
| Third bill | Counterfeit/torn state |
| ... | ... |

Fig.7

| Denomination | Genuine Characteristic Data | | | | Front/ back |
|---|---|---|---|---|---|
| | Genuine image data | Genuine external ship date | Genuine magnetic data | Genuine thickness data | |
| ¥10,000 | 10000 | | | th11 … th1n<br>th21 ⋮<br>thmn | Front |
| | | | | | |
| | | | | | |
| | | | | | |

583

Forward small fold status

Reverse small fold status

APPARATUS AND A METHOD FOR PROCESSING PAPER CURRENCY

INCORPORATION BY REFERENCE

The entire disclosure of Japanese Patent Application No. 2005-197761, filed Jul. 6, 2005, is expressly incorporated by reference.

BACKGROUND OF THE INVENTION

1. Field of the Invention

The present invention relates to handling of partially folded paper currency.

2. Description of Related Technologies

Dog-eared paper currency, which is paper currency wherein a corner part is folded, is often an impediment to stabilized operation of automated teller (ATMs) by causing jams when the folded parts get into the joints in the conveyance paths within the equipment, destabilizing the paper currency conveyers because of the thickness of the folded parts, and so forth. Consequently, typically dog-eared paper currency is returned to the user. Usually the user who has received the rejected dog-eared paper currency straightens the currency to correct the problem and reinserts the paper currency into the ATM. Japanese Unexamined Patent Application Publication H 7-14048 and Japanese Unexamined Patent Application Publication 2003-288628 described these types of related technologies.

SUMMARY

However, if the direction in which the user reinserts the paper currency is not good, the corner of the paper currency may be folded again through the use of the rollers in the conveyance system because the direction of conveyance is not good, causing the paper currency to be rejected again as being dog-eared paper currency. In this case, the user may have to fix the folds and reinsert the paper currency any number of times, with the problem that this costs the user too much time.

This type of problem is not limited to dog-eared paper currency wherein the corner part of the paper currency is folded, but rather is the same problem for creased paper currency that is partially torn, where the location where the tear curls and folds back. Furthermore the problem is not limited to ATMs, but rather is also common to chase dispensers, ticket vending machines, and other automatic transaction machines or money handling machines that have functions that handle paper currency.

The present invention was created to solve the problem described above, and the object thereof is to provide a technology aiming to reduce the burden on the user when inserting creased currency.

In order to solve, at least in part, the problem described above, the apparatus according to the present invention an apparatus for processing paper currency, comprising: a sensor unit for acquiring deposited paper currency characteristic data indicating characteristics of deposited paper currency by reading characteristics of the deposited paper currency; a folded paper currency determining unit for determining if the deposited paper is a folded paper currency or not, based on the deposited paper currency characteristic data, the folded paper currency having a possibility to have a folded portion, the determination being based on whether or not there is a missing area in the deposited paper currency; and a fold correcting processing unit for executing a fold correcting process in order to correct the fold in the deposited paper currency if the deposited paper currency is the folded paper currency.

The apparatus according to the present invention, with the object of reducing the time for the user when folded paper currency is inserted, is able to execute a fold correction process for correcting the fold in the folded paper currency.

Furthermore, a conveying unit for conveying the paper currency may be provided, the fold correcting process may be a process for controlling the conveying unit to reverse a direction of conveyance of the deposited paper currency.

Moreover, it is possible to correct the fold in the deposited paper currency through reversing the direction of conveyance of the deposited paper currency.

The aforementioned fold correcting process is a process for returning the deposited currency to a user and displaying a guidance indicative of a direction of reinsertion of the returned deposited paper currency. The direction of reinsertion is a direction in which there is a possibility that the fold will be corrected at a time of conveyance of the deposited paper currency.

Given this, there is the possibility of the user correcting the folds, by returning the paper currency to the user. Even if the user does not correct the folds, by looking at the guidance that is displayed, indicating that the paper currency is to be reinserted in a direction in which it is possible to correct the folds during conveyance of the deposited paper currency, there will be the possibility that the folds in the deposited paper currency will be corrected during transport. If the paper currency was inserted in a direction wherein it is possible to correct the fold in the deposited paper currency during transport, then the probability that there will be another fold in the paper currency during transport will be low.

The deposited paper currency characteristic data includes image data of the deposited paper currency within the apparatus, and the fold correcting processing part may display, in the aforementioned instructions, an image of the deposited paper currency based on the aforementioned image data.

Doing this makes it possible to show to the user an image of the deposited paper currency within the apparatus.

The aforementioned fold correcting processing part may further be provided with a determining part that determines, based on the aforementioned deposited characteristic data, whether or not there is the possibility of correcting the fold when the deposited paper currency is folded paper currency; wherein the aforementioned determining part may perform the aforementioned fold correcting process only when it has been determined that there is the possibility of correction.

When it has been determined that there is the possibility of correcting the fold, then the fold correction process is performed, thus reducing the execution of unnecessary fold correcting processes.

Furthermore, a conveying unit for conveying the paper currency may be provided, and the aforementioned determining part may determine whether or not it is possible to correct a fold in the deposited paper currency based on determining whether or not the position of a part corresponding to the crease of the fold in the deposited paper currency is facing the direction of conveyance in the state in which the deposited paper currency is being conveyed.

The determining part may be a part that determines whether or not it is possible to correct a fold in the deposited paper currency through determining whether or not the size of the aforementioned missing area is larger than a predetermined threshold value.

The aforementioned fold correcting processing unit may further be provided with a return part that returns the deposited paper currency if it is determined by the aforementioned determining part that there is no probability of correcting the fold in the aforementioned deposited paper currency.

Given this, the deposited paper currency is returned to the user if it is determined that the fold cannot be corrected, making it possible to prevent the deposited paper currency from becoming an obstruction to the stable operation of the apparatus.

The aforementioned fold correcting processing part may further be provided with a memory part for storing genuine characteristic data that indicates the characteristics of genuine paper currency, an authenticity determining part that determines whether or not the aforementioned deposited paper currency is a genuine paper currency that is folded, based on the aforementioned deposited paper currency characteristic data and the aforementioned genuine characteristic data, where the aforementioned paper correcting process is performed only for those notes wherein the deposited paper currency is genuine, with a fold.

Given the above, the fold correcting process is performed only when the deposited paper currency is genuine, thus reducing the performance of unnecessary fold correcting processes.

The aforementioned authenticity determining part may determine whether or not a deposited paper currency is genuine with a fold by determining, based on the aforementioned genuine currency characteristic data, whether or not the deposited currency is genuine with a fold through generating characteristic data, when there is a fold in genuine currency the produces the aforementioned missing area, and comparing this characteristic data to the aforementioned deposited paper currency characteristic data.

The aforementioned characteristics may be at least one of the following: the paper currency design, magnetism added to the paper currency, and thickness of the paper currency.

The aforementioned folded paper currency may be dog-eared paper currency wherein a corner of the paper currency is folded, or may be torn paper currency wherein a part of the paper currency is torn and the torn part of the paper currency is folded.

Conversely, in order to at least partially solve the problem described above, the apparatus according to the present invention is An apparatus for executing a deposit transaction or a payment transaction using paper currency, comprising a conveying unit for conveying the paper currency, and a fold correcting processing part for performing a fold correcting process that changes, to the reverse direction, the direction of conveyance of the paper currency for the purpose of correcting a fold in the deposited paper currency regardless of whether or not there is a fold in a part of the paper currency that has been deposited.

Given the present invention, the fold correcting process is performed regardless of whether or not there is a fold in a part of the paper currency that has been deposited, and thus it is also possible to correct a fold, if there is one, through the fold correcting process, eliminate the determination of whether or not there is a fold in the deposited paper currency. This makes it possible to reduce the time for the user when folded paper currency has been inserted.

Note that the present invention may be embodied in a variety of forms, for example, the present invention can be embodied as a method, as a paper currency discriminating apparatus and method, as a computer program for producing the functions of these methods or apparatus, as a recording medium upon which said computer program is recorded, and so forth.

BRIEF DESCRIPTION OF THE DRAWINGS

FIG. 6 is an explanatory diagram illustrating the paper currency state memory area 582 when the deposited paper currency Pm has been inserted in a plurality of notes at one time into the ATM 1000;

FIG. 7 is an explanatory diagram illustrating the genuine characteristics DB583;

DETAILED DESCRIPTION OF THE INVENTION

In the below, preferred forms of embodiment of the present invention will be described in detail referencing the figures.

Figure 1:
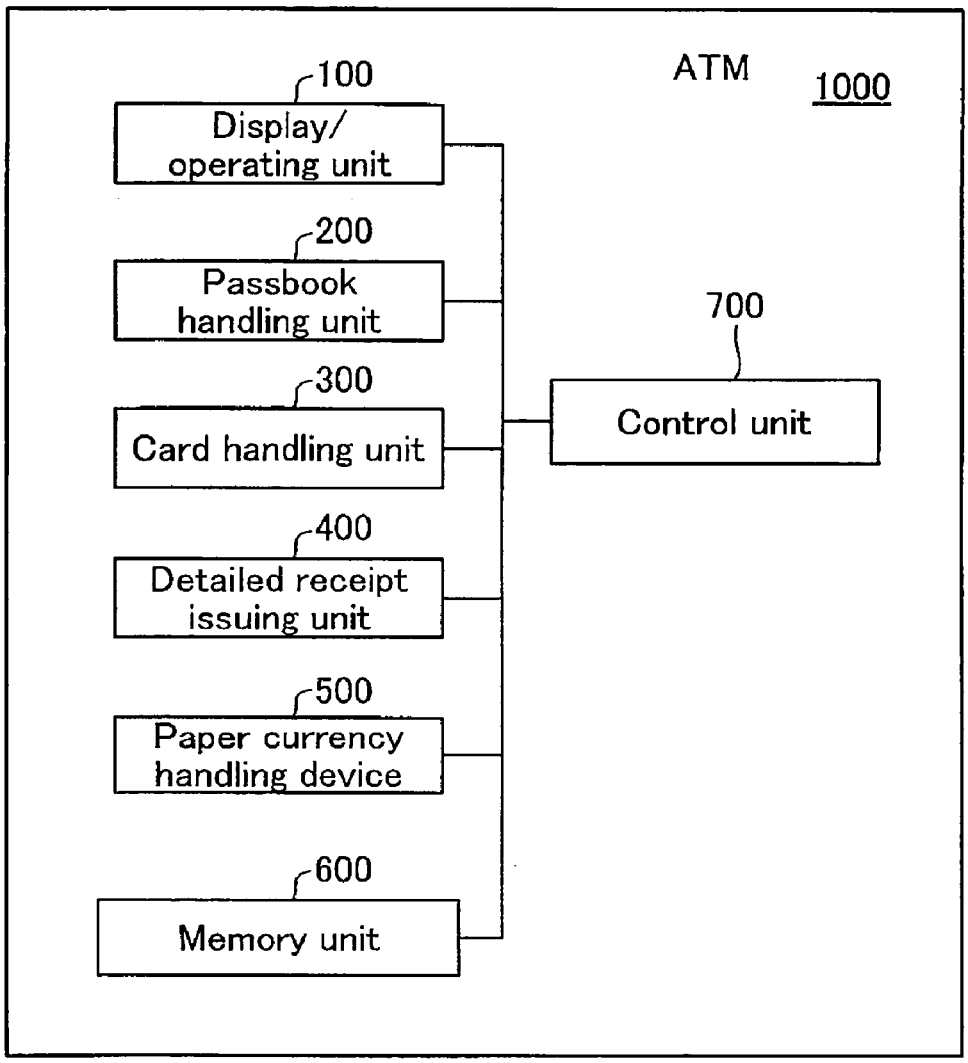
FIG. 1 is a block diagram illustrating an ATM (Automated Teller Machine) that is one type of apparatus according to the present invention.

FIG. 1 is a block diagram illustrating an ATM (Automated Teller Machine) that is one type of apparatus according to the present invention. The ATM 1000 has a function that executes a fold correcting process intended to correct a fold (lay out the fold) in folded paper currency wherein one part is folded. The ATM 1000 has a display/operating unit 100, a passbook handling unit 200, a card handling unit 300, a detailed receipt issuing unit 400, a paper currency handling apparatus 500, a memory unit 600, and a control unit 700.

The display/operating unit 100 displays guidance (instructions) such as the details of operations, and has a touch panel that receives inputs from the user regarding the details of transactions. The passbook handling unit 200 reads out the bank account number from a passbook that is inserted by the user, and has a function that, for example, prints the balance in the passbook. The card handling unit 300 has a function that reads out the bank account number from a cash card that is inserted by the user. The detailed receipt issuing unit 400 has a function that prints and issues a detailed receipt indicating the details of the transaction. The paper currency handling apparatus 500 handles the deposited paper currency that is deposited by the user in order to perform the transaction.

Note that the deposited paper currency is not limited to paper currency that is deposited for a deposit transaction, but also includes paper currency that is deposited for a payment transaction using cash.

Figure 2:
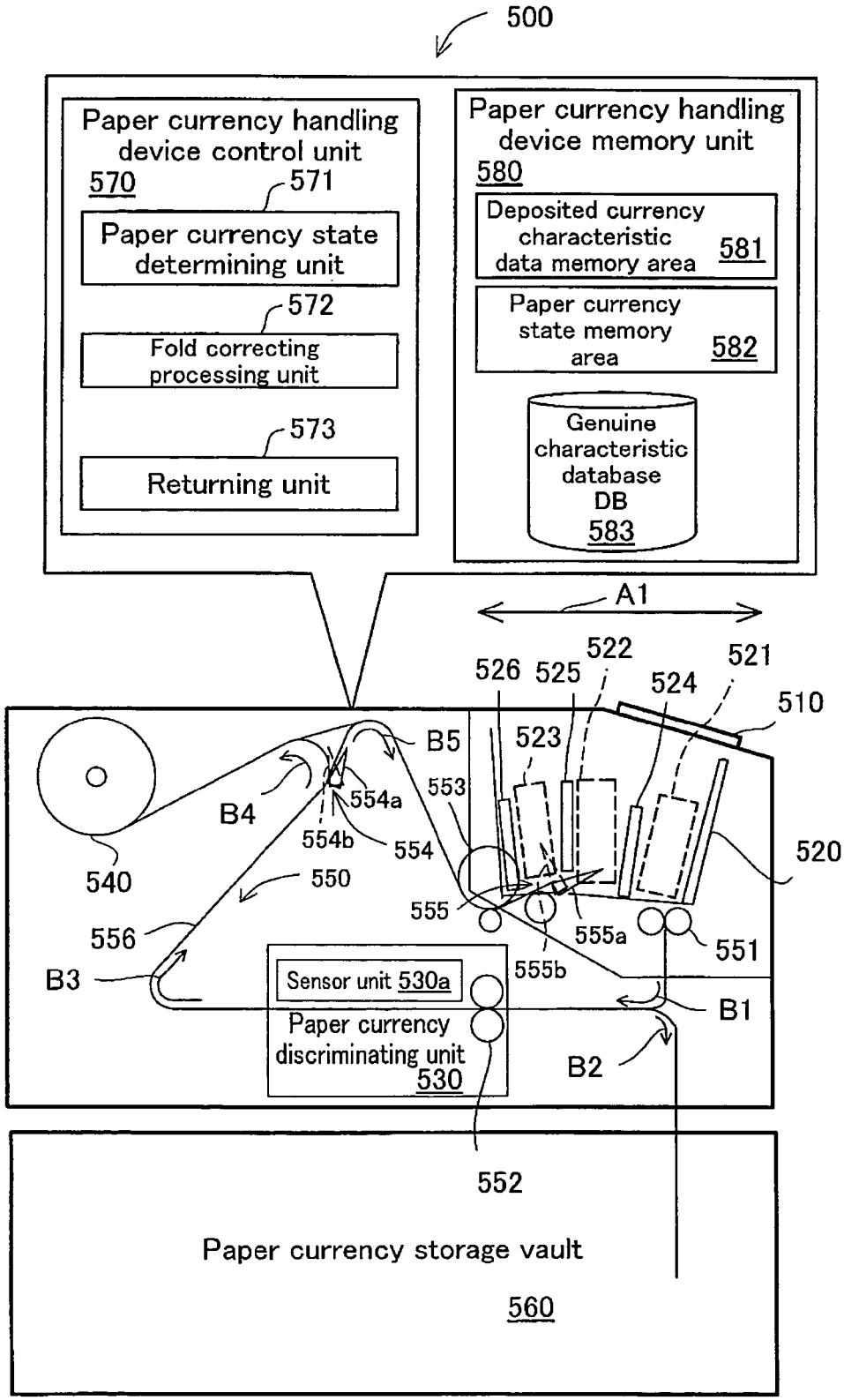
FIG. 2 is an explanatory drawing illustrating a paper currency handling apparatus 50.

FIG. 2 is an explanatory diagram illustrating a paper currency handling apparatus 500. At the top is shown a block diagram for a paper currency handling apparatus control unit apparatus 570 and a paper currency handling apparatus memory unit 580. The details will be described below. The paper currency handling apparatus 500 has a cash deposit/withdrawal opening 510, a paper currency deposit/withdrawal receptacle unit 520, a paper currency discriminating unit 530, a temporary storage vault 540, a conveying unit 550, and a paper currency storage vault 560. The cash deposit/withdrawal opening 510 is an openable/closeable shutter, and is opened when the user deposits the money.

The paper currency deposit/withdrawal receptacle unit 520 is provided with separating plate 524 to 526, where an insertion area 521, a resend area 522, and a return area 523 are divided by the separating plates 524 and 525. The separating plates 524 to 526 can be moved in both directions shown by the arrow A1 within the paper currency deposit/withdrawal receptacle unit 520 by the functioning of a movement control apparatus, not shown.

Figure 3A:
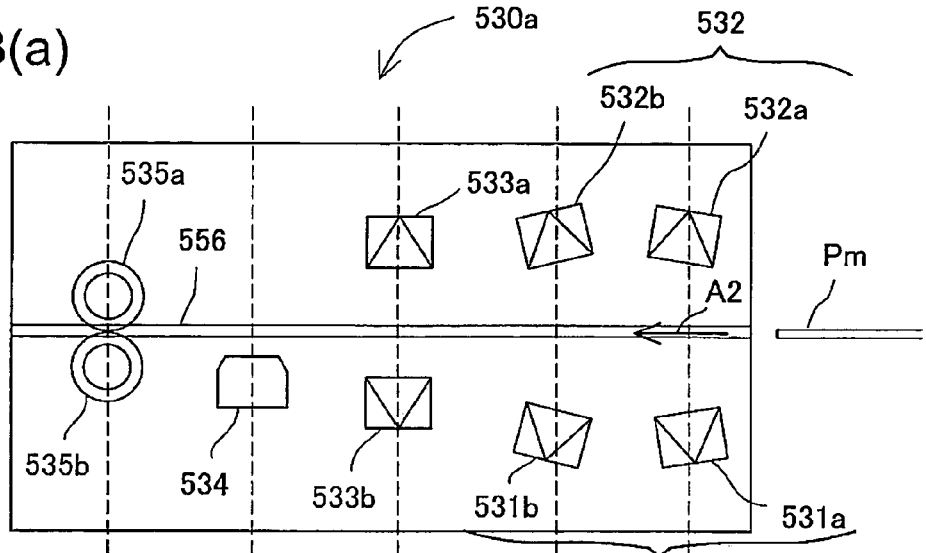
FIG. 3 is an explanatory diagram illustrating a sensor unit 530*a;*
Figure 3B:
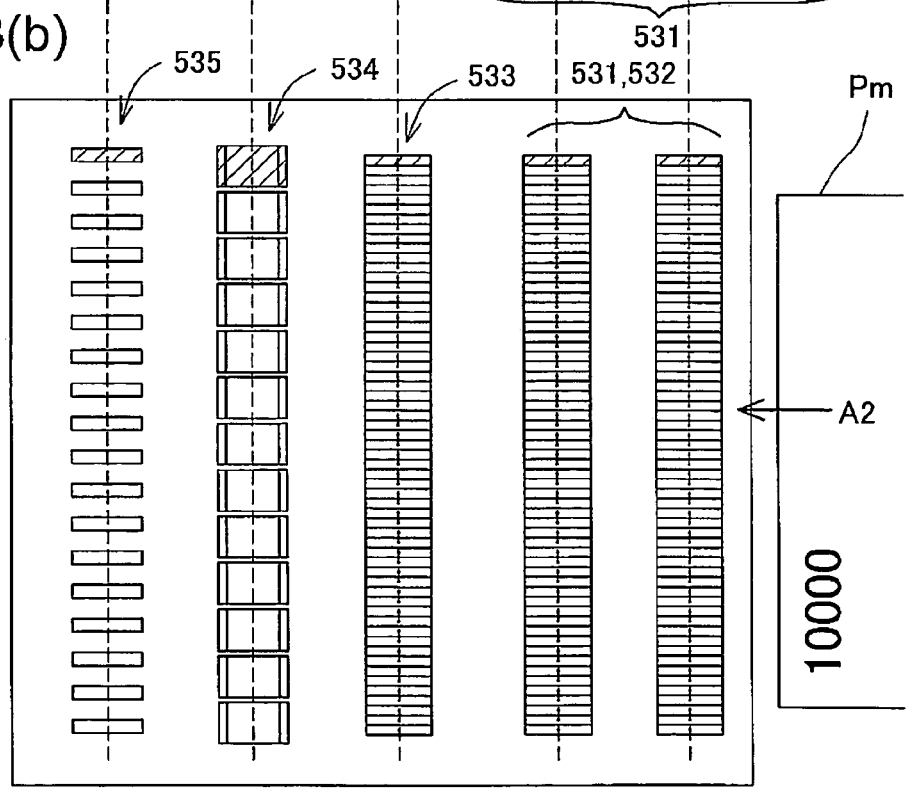
Figure 4A:
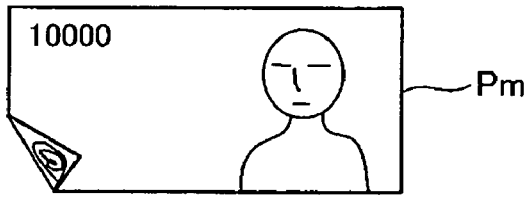
FIG. 4 is an explanatory diagram for illustrating the deposited paper currency characteristic data.
Figure 4B:
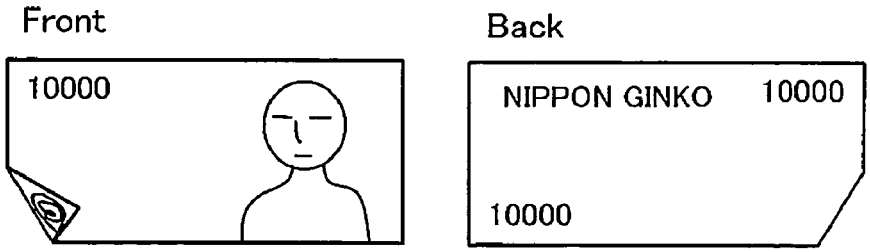
Figure 4C:
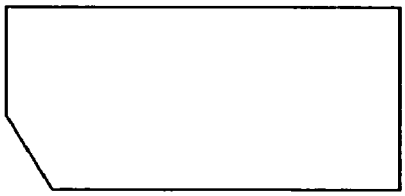
Figure 4D:
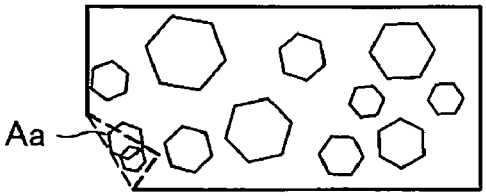
Figure 4E:
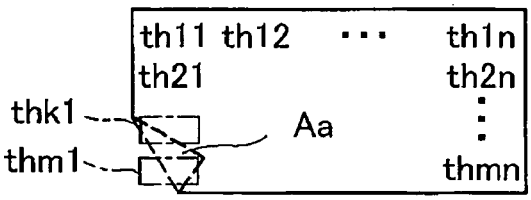
Figure 5A:
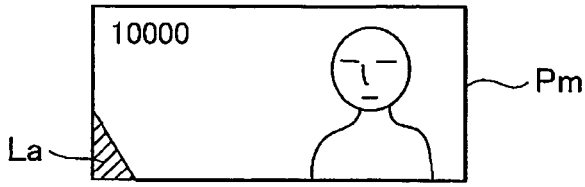
FIG. 5 is an explanatory diagram for illustrating the states of the paper currency.
Figure 5B:
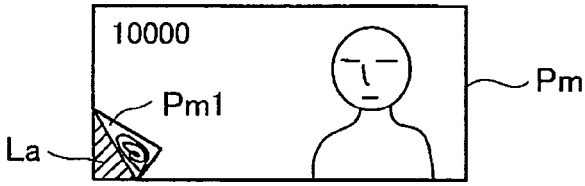
Figure 5C:
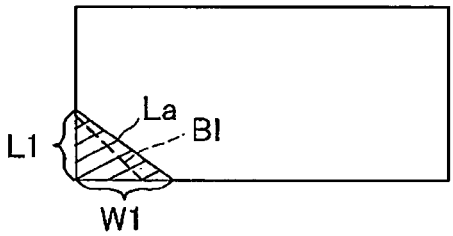
Figure 5D:
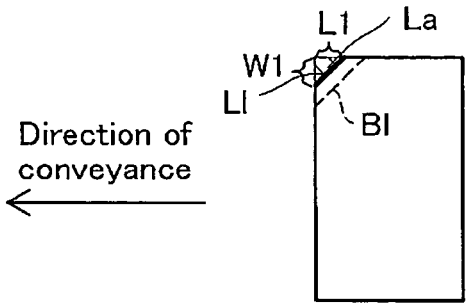
Figure 5E:
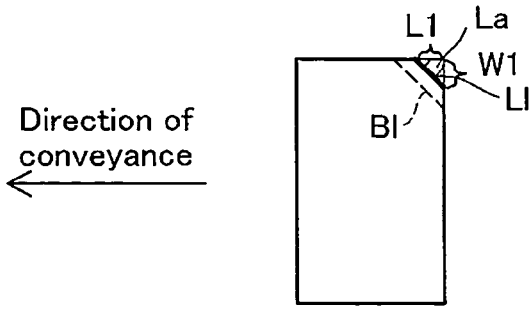

The paper currency discriminating unit 530 is provided with a sensor unit 530*a*. FIG. 3 is an explanatory diagram illustrating the sensor unit 530*a*. FIG. 3 (*a*) is a schematic diagram of a vertical section of the sensor unit 530*a*, and FIG. 3 (*b*) is a schematic diagram of horizontal section of the sensor unit 530*a*. In FIG. 3 (*b*), the shaded parts each correspond to one sensor. For each of the sensors 531 to 535, a plurality of sensors is lined up laterally across a distance that is longer than the width of the paper currency. Each of the sensors 531 to 535 can independently read the characteristics of the deposited paper currency Pm that is conveyed thereto in the direction shown by the arrow A2.

Note that the number of the sensors 531 to 533 shown in the figure is merely an example, and actually a greater number of sensors will be lined up laterally than shown in the figure.

The sensor unit 530*a* is provided with two reflective color sensors 531 and 532, a transmissive sensor 533, a magnetic sensor 534, and a thickness sensor 535.

The light-emitting part 531*a* and the light-receiving part 531*b* of the reflected color sensor 531 are disposed on the same side from the perspective of paper currency. The same is true also for the light-emitting part 532*a* and the light-receiving part 532*b* of the other reflected color sensor 532. The reflected color sensors 531 and 532 read out images of both sides of the deposited paper currency, which are stored in the deposited paper currency data memory area 581, shown in FIG. 2, as deposited paper currency image data. The images correspond to the design in the present invention. FIG. 4 (*b*) is a schematic diagram illustrating an image of a deposited paper currency note based on the deposited paper currency image data in the case of the deposited paper currency Pm being that which is in FIG. 4 (*a*). There is a part that is folded in the deposited paper currency Pm in FIG. 4 (*a*), and the fold can be confirmed in the image of the deposited paper currency PM in FIG. 4 (*b*), as well.

The light-emitting part 533*a* and the light-receiving part 533*b* of the transmissive sensor 533 in FIG. 3 are disposed on opposite sides with the paper currency interposed there between. The transmissive sensor 533 reads out the shape of the paper currency, and stores the result in the deposited paper currency characteristic data memory area 581 as deposited paper currency external shape data. FIG. 4 (*c*) is an explanatory diagram illustrating the external shape of deposited paper currency based on the deposited paper currency external shape data for the deposited paper currency Pm. In the external shape of the deposited paper currency Pm of FIG. 4 (*c*) it can be seen that a part of the paper currency is missing.

The magnetic sensor 534 of FIG. 3 reads the magnetic properties of magnetic ink used in printing of the deposited paper currency Pm, and stores the result in the deposited paper currency characteristic data memory area 581 as deposited paper currency magnetic data. FIG. 4 (*d*) is an explanatory diagram illustrating a magnetic pattern of the deposited paper currency based on the deposited paper currency magnetic data. FIG. 4 (*d*) is an example of a magnetic pattern. In the magnetic pattern for the deposited paper currency Pm of FIG. 4 (*d*) the magnetism stacks in the folded area Aa shown by the dotted line.

The thickness sensor 325 of FIG. 3 measures the thickness of the paper currency from the amount of movement of the axels of rollers 535*a* and 535*b* as the paper currency passes between these two rollers 535*a* and 535*b*. Furthermore, the thicknesses are stored in the deposited paper currency characteristic data memory area 581 as deposited paper currency thickness data. FIG. 4 (*e*) is an explanatory diagram illustrating the thickness of the deposited paper currency Pm based on the deposited paper currency thickness data. thll through thmn illustrate the thicknesses of the various positions in the deposited paper currency.

The deposited paper currency image data, the deposited paper currency external shape data, the deposited paper currency magnetic data, and the deposited paper currency thickness data is, together, referred to as the deposited paper currency characteristic data. Note that the external shape of the deposited paper currency Pm can also be discerned from the deposited paper currency image data.

The temporary storage vault 540 of FIG. 2 is An apparatus for storing paper currency temporarily prior to storage of the deposited paper currency Pm in the paper currency storage vault 560 when the deposited paper currency Pm is genuine (genuine paper currency). The conveying unit 550 is provided with conveying rollers 551 through 553, switching gates 554 and 555, and a conveying path 556. The conveying rollers 551 to 553 each operate by rotating as a pair of rollers to convey the deposited paper currency Pm along the conveying path 556. The conveying rollers 551 to 553 may exist in a large number, different from that which is shown in the figure. The switching gates 554 and 555 switch the direction in which the deposited paper currency Pm is conveyed. Details will be described below. The paper currency storage vault 560 stores genuine paper currency. Paper currency aside from the genuine paper currency may be stored as rejected paper currency that is unusable.

The paper currency handling apparatus control unit 570 has a paper currency state determining unit 571, a fold correcting processing unit 572, and a return unit 573. The paper currency handling apparatus control unit 570 determine whether or not there is potentially a fold in a portion of the deposited paper currency Pm based on whether or not there is a missing area wherein a portion of the deposited paper currency Pm is missing. The paper currency handling apparatus control unit 570 corresponds to the folded paper currency determining unit in the present invention. The paper currency state determining unit 571 determines the paper currency state of the deposited paper currency Pm when there is a missing area in the deposited paper currency Pm, and stores the results in the paper currency state memory area 582.

FIG. 5 is an explanatory drawing for illustrating the paper currency states. The paper currency states include the counterfeit/torn state, the large fold state, the forward small fold state, and the reverse small fold state. FIG. 5 (*a*) and (*b*) illustrate example of deposited paper currency Pm in the counterfeit/torn states. FIG. 5 (*a*) is deposited papery currency wherein a portion of the paper currency is torn. FIG. 5 (*b*) is deposited paper currency Pm wherein a counterfeit paper currency Pm1, made using, for example, a color copier, is adhered. As is shown in FIG. 5 (*a*) and (*b*), if the deposited paper currency Pm is not the paper currency wherein genuine currency is folded (hereinafter termed "folded genuine currency"), even if there exists a missing area La, indicated by the diagonal lines, the paper currency state determining unit 571 will store the fact that the paper currency is counterfeit/torn in the paper currency state memory area 582. There are also various other types of counterfeit/torn state deposited paper currency Pm, such as torn counterfeit paper currency.

FIG. 5 (*c*) shows an example of the external shape of deposited paper currency Pm in the large fold state. The deposited paper currency Pm is genuine folded paper currency, and if the length L1 or the width W1 of the missing area shown by the dotted lines, such as shown in FIG. 5 (*c*), is greater than a threshold value B1 (for example, 20 mm in the vertical direction or 20 mm in the horizontal direction), then the paper currency state determining part 571 will store the large-fold paper currency state for the paper currency in the paper currency state memory area 582.

FIG. 5 (*d*) shows an example of the external shape of a forward small fold state deposited paper currency Pm. The deposited paper currency Pm is genuine folded paper currency, and if both the length L1 and the width W1 of the missing area La, as shown in FIG. 5 (*d*), are less than the threshold value B1, then the small fold state is acknowledged. Moreover, if, in this small fold state, the position corresponding to the crease at the fold L1, shown by the heavy line in FIG. 5 (*d*) faces the forward direction of the conveyance direction for the paper currency, then the paper currency state determining unit 571 stores in the paper currency state memory area 582 that the paper currency is in the forward small fold state.

FIG. 5 (*e*) shows an example of the external shape for a deposited paper currency Pm in the reverse small fold state. The reverse small fold state is a small fold state wherein the position corresponding to the crease of the fold L1 is facing in the backwards direction of the direction of conveyance for the paper currency. At this time, the paper currency state determining part 571 stores in the paper currency state memory area 582 that the paper currency is in the reverse small fold state. The paper currency state determining unit 571 corresponds to the determining unit and the genuine determining unit as well in the present invention.

The fold correcting processing unit 572 in FIG. 2 performs a fold correcting process intended to correct a fold in deposited paper currency Pm in the forward small fold state. The return part 573 returns, to a return area 523, any deposited paper currency in the counterfeit/torn state, the large-folded state, or the reverse small folded state.

The paper currency handling apparatus memory unit 580 is provided with a deposited paper currency characteristic data memory area 581, a paper currency state memory unit 582, and a genuine characteristic database (DB) 583. The deposited paper currency characteristic data memory area 581 is an area for storing the deposited paper currency characteristic data, as described above.

The paper currency state memory area 582 is an area for storing the paper currency state of the deposited paper currency Pm, as described above. FIG. 6 is an explanatory diagram illustrating the paper currency state memory area 582 in the case of a plurality of deposited paper currency Pm being deposited at one time into the ATM 1000. Here the paper currency states of the deposited paper currency Pm are stored in the paper currency state memory area 582 in the sequence in which the deposited paper currency Pm is conveyed.

FIG. 7 is an explanatory diagram illustrating the genuine characteristic database 583. The genuine characteristic database 583, as shown in the figure, stores in advance, for each side of each denomination, genuine image data, external shape data, magnetic data, and thickness data (hereinafter termed, respectively, the "genuine image data," "genuine external shape data," "genuine magnetic data," and "genuine thickness data"). The genuine image data, the genuine external shape data, the genuine magnetic data, and the genuine thickness data, are termed, together, the "genuine characteristic data." The data that is stored may not be limited to data regarding Japanese paper currency, but may also store genuine characteristic data for foreign paper currency as well.

The memory unit 600 in FIG. 1 stores a variety of types of data and programs. The control unit 700 performs overall control of the various parts and various apparatuses of the ATM 1000.

Figure 8:
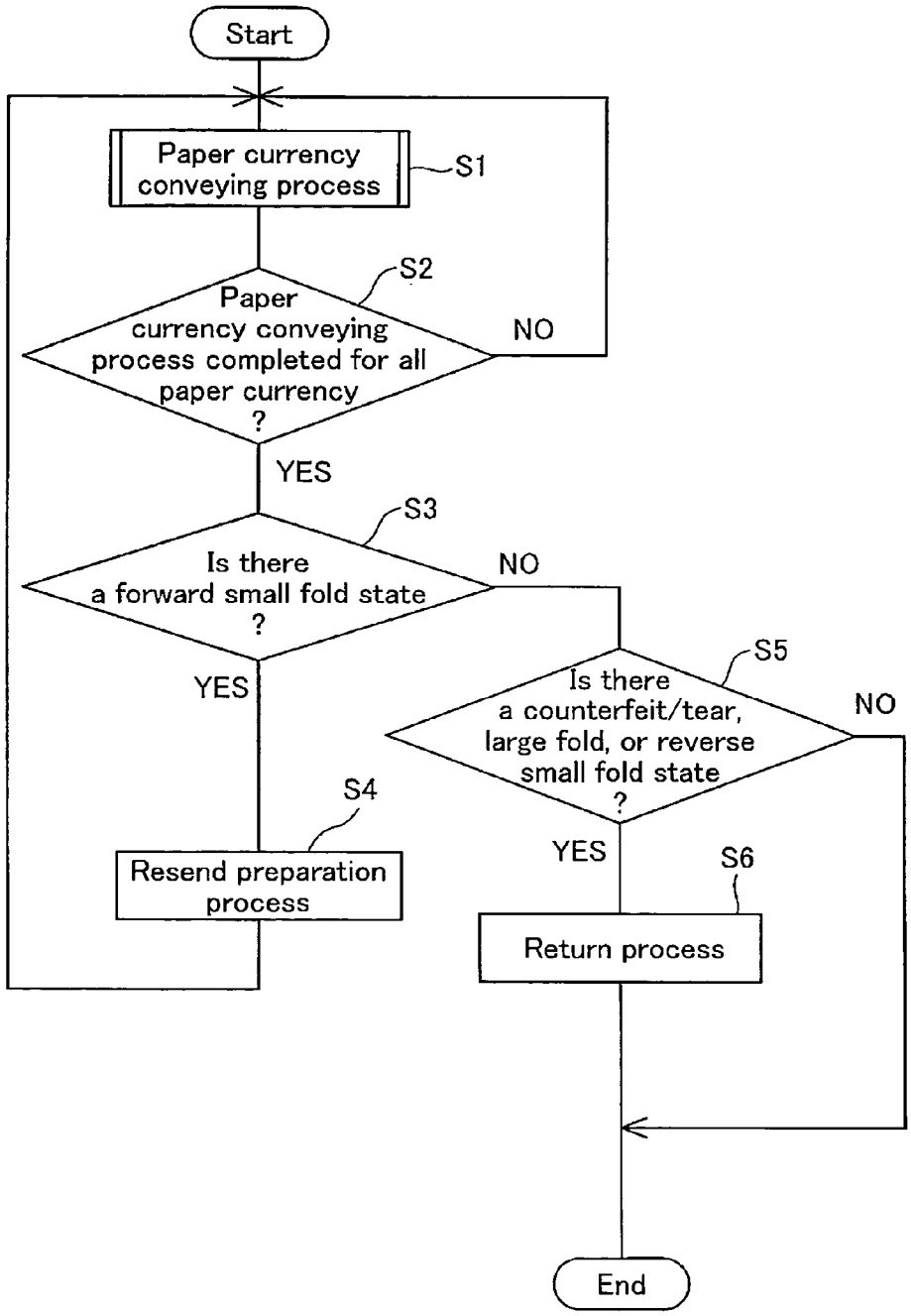
FIG. 8 is a flow chart illustrating the processing when depositing money, performed by the ATM 1000.

FIG. 8 is a flow chart illustrating processes performed by the ATM 1000 when paper currency is deposited. The paper currency handling apparatus control unit 570 of the ATM 1000 first initializes the paper currency state memory area 582 and performs the paper currency transport process (Step 1).

Figure 9:
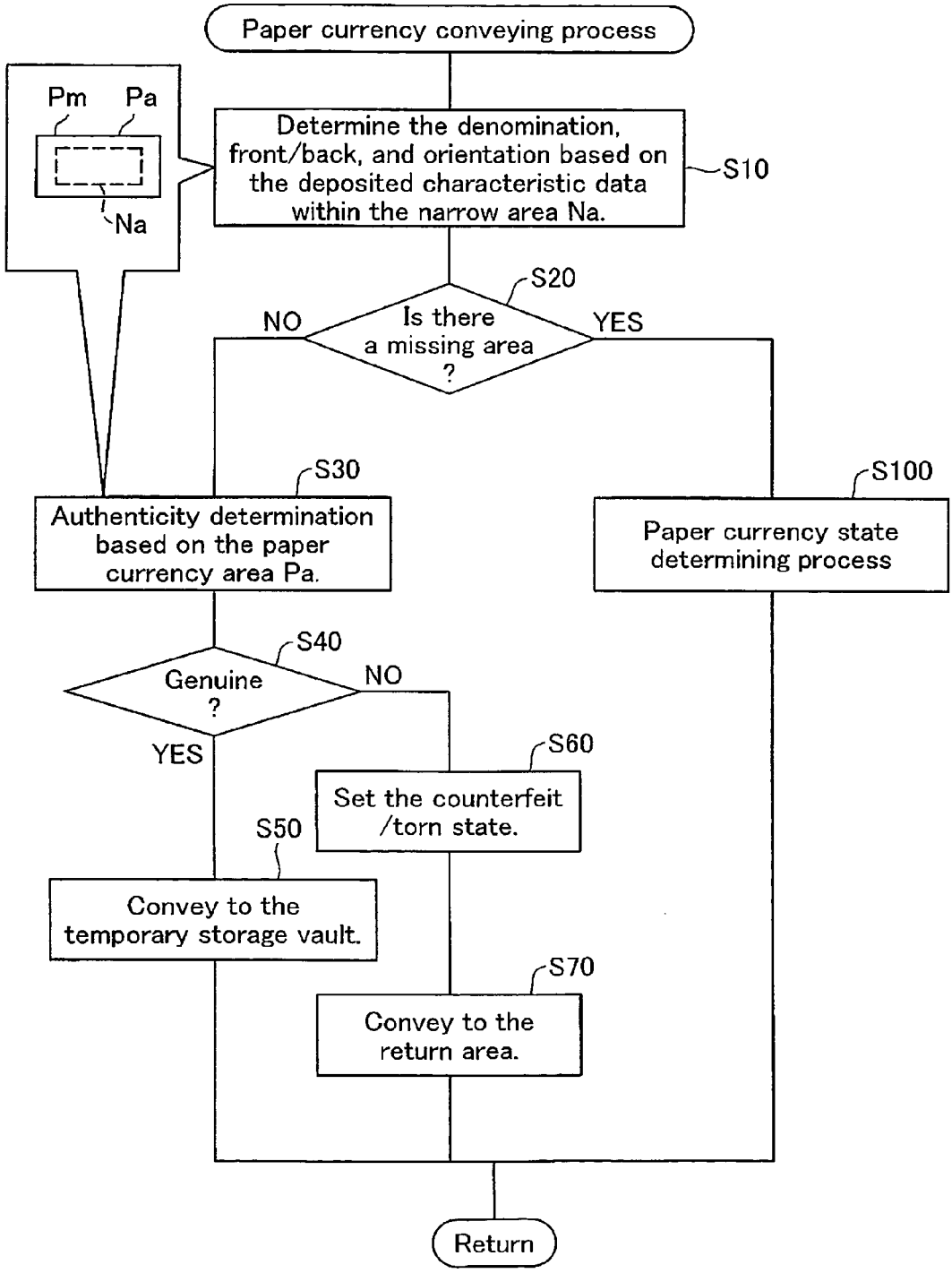
FIG. 9 is a flow chart illustrating the paper currency conveying process.

FIG. 9 is a flow chart illustrating the paper currency conveying process. When inserting money, the user inserts the paper currency into the insertion area 521 in FIG. 2. The paper currency handling apparatus control unit 570 shifts the separating plate 524 in the direction of the right arrow of the arrow A1, and conveys one of the paper currency from within the insertion area 521 following the arrow B1, causing the paper currency to arrive at the sensor unit 530*a*. The sensor unit 530*a* reads out the deposited paper currency characteristic data for the deposited paper currency Pm, and stores the data in the deposited paper currency characteristic data memory area 581.

When the deposited paper currency characteristic data is stored in the deposited paper currency data memory area 581, the paper currency handling apparatus control unit 570 searches the genuine characteristic database 583, shown in FIG. 7, using the deposited paper currency characteristic data, to retrieve the denomination, front or back, and orientation of the deposited paper currency Pm. (Step S10) This process is performed through comparing the deposited paper currency characteristic data within the narrow area Na in the deposited paper currency Pm shown in FIG. 9 to the genuine characteristic data within the narrow area Na. The reason for this is to determine the denomination, front/back, and orientation regardless of the presence or absence of a small fold.

Next the paper currency handling apparatus control unit 570 compares the deposited paper currency external shape data of the deposited paper currency Pm to the genuine external shape data to determine whether or not there is a missing area La in the deposited paper currency Pm (Step S20). If there is not, then the authenticity decision is made for the deposited paper currency Pm (Step S30). At this time, the determination is made by comparing the deposited paper currency characteristic data in a paper currency area Pa of the deposited paper currency Pm shown in FIG. 9 to the genuine characteristic data within the paper currency area Pa.

If the deposited paper currency Pa is genuine (Step S40: Yes), then the paper currency handling apparatus control unit 570 sets the switching gate 554 in FIG. 2 to the state 554*b* shown by the dotted line, to convey the deposited paper currency Pm along arrow B3 and arrow B4 to the temporary storage vault 540. If the deposited paper currency Pm is not genuine (Step S40: No) then the paper currency handling apparatus control unit 570 stores the counterfeit/torn state in the paper currency state memory area 582 (Step S60). Moreover, the switching gate 554 in FIG. 2 is put to state 554*a*, and the switching gate 555 is put to the state 555*b* shown by the dotted line and the paper currency is conveyed to the return area 523 along arrow B3 and arrow B5 (Step S70).

Figure 10:
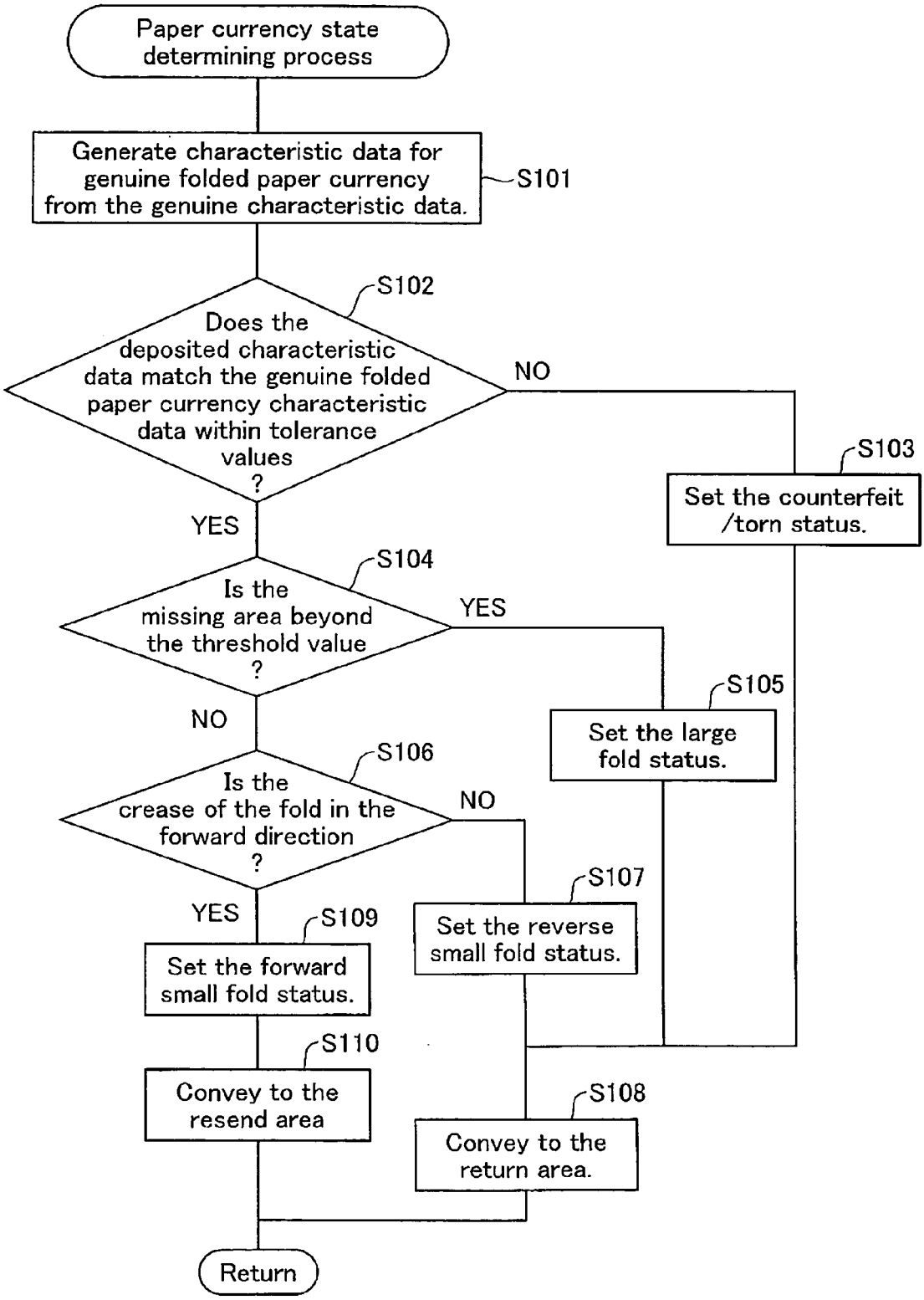
FIG. 10 is a flow chart illustrating the paper currency state determination process.

On the other hand, if there is a missing area La in the deposited paper currency Pm (Step S20: Yes), then the paper currency state determining unit 571 performs the paper currency state determining process (Step S100). FIG. 10 is a flow chart illustrating the paper currency state determining process. The paper currency state determining unit 571 first generates characteristic data for a genuine folded paper currency from the genuine characteristic data in order to check whether or not the deposited paper currency Pm is genuine folded paper currency (Step S101).

Figure 11:
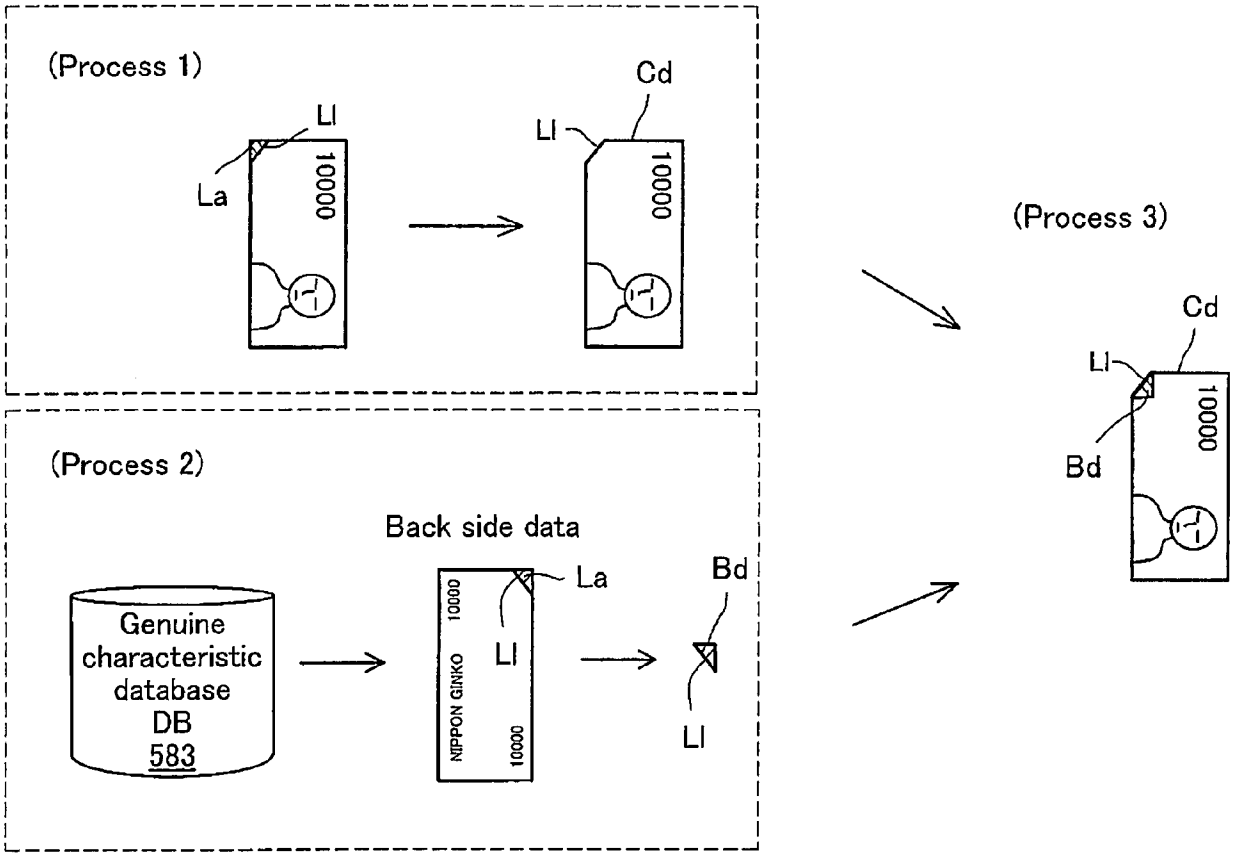
FIG. 11 is an explanatory diagram illustrating the process for generating the genuine folded paper currency image data.

FIG. 11 is an explanatory diagram illustrating the process for generating the image data for the genuine folded paper currency. The paper currency state determining unit 571 first removes image data within the missing area La from the genuine image data that was applied in Step S10 in FIG. 9 to generate the cut image data Cd (Process 1). After this, then genuine image data is retrieved from the genuine characteristic database 583, retrieving image data for the back if the genuine image data is that of the front, or retrieving genuine image data for the front, if the genuine image data is that of the back, to thereby acquire the image data within the missing area La of the genuine image data that has been retrieved (Process 2). The image data that has been achieved shall be termed the "folded part image data" Bd. After this, a folded part image data Bd is laid over the cut part image data Cd, so as to align the fold lines L1 (Process 3). In this image data, the overlaying is done so that only the folded part image data Bd will remain in the overlaying part. Processes 1 through 3 generate the genuine folded paper currency image data. Note that while the deposited design data will have parts from both sides, as shown in FIG. 4 (*b*), from the missing area La it is not clear whether the fold is on the front or the back, and thus there will be image data for the genuine folded paper currency for both the case wherein the fold is folded towards the front and the case wherein the fold is folded towards the back.

The genuine folded paper currency magnetic data, thickness data, and image data are generated similarly, for the magnetic data and thickness data, the overlay part is produced through overlaying by adding together the data for the folded part image data Bd and the cut image data Cd.

Next, the paper currency state determining unit 571 compares the deposited characteristic data and the genuine folded paper currency characteristic data for the image data, the magnetic data, and the thickness data (Step S102). If not all of the individual characteristic data match within the predetermined tolerance values, then, the deposited paper currency is not genuine folded paper currency, and so the counterfeit/torn state is stored in the paper currency state memory area 582 (Step S103). However, for the image data, if one of the two sides matches beyond a tolerance value, then the decision of genuine folded paper currency may be made. When the paper currency is a counterfeit/torn state, then the return part 573 conveys the deposited paper currency Pm to the return area 523, shown in FIG. 2 (Step S108).

If matching beyond the tolerance value, an investigation is performed on the deposited external diameter data as to whether either the length L1 or width W1 of the missing part La are outside of the respective threshold values B1 (Step S104). If the length L1 or the width W1 is greater than the threshold value B1 then the folded-large state is stored in the paper currency state memory area 582 (Step S105), and the deposited paper currency Pm is conveyed to the return area 523 (Step S108).

If both the lengths length L1 and width W1 are less than the threshold values B1, then an investigation is performed as to whether the crease of the fold L1 is facing in the forward direction of the conveyance direction of the paper currency, based on the deposited external shape data (Step S106). If not in the forward direction, then the reverse small fold state is stored in the paper currency state memory area 582 (Step S107), and the deposited paper currency Pm is conveyed to the return area 523 (Step S108).

If facing the forward direction (Step S106: Yes) then the forward small fold state is stored in the paper currency state memory area 582 (Step S109). Following this, the fold correcting processing unit 572 not only switches the switching gate 554, shown in FIG. 2, to the state 554*a*, but also switches the switching gate 555 to the state 555*a*, and the deposited paper currency Pm is conveyed to the resend area 522 along arrow B3 and arrow B5 (Step S110). The paper currency that has a forward small fold state will have the crease of the fold L1 to the top when conveyed to the resend area 522 (FIG. 5 (*d*)) at the sensor unit 530*a*. Consequently, when the deposited paper currency Pm is resent along the arrow B1, the direction of conveyance of the deposited paper currency Pm will be exactly the opposite. In other words, the process of conveying the deposited paper currency Pm to the resend area 522 corresponds to the process of changing the direction of conveyance of the deposited paper currency Pm to be the opposite direction.

Once the paper currency conveying process, as described above, has been performed for all of the paper currency, that was inserted into the insertion area 521 (Step S2 in FIG. 8: Yes), the fold correcting processing unit 572 references the paper currency state memory area 582 of FIG. 6 to investigate whether or not there is a forward small fold in the paper currency state (Step S3). If there is, then the fold correcting processing unit 572 erases all of the forward small fold states from the paper currency state memory area 582 and performs the resend preparation process (Step S4). In the resend preparation process, specifically the separating plate 524 and the separating plate 525 in FIG. 2 are shifted in the direction of the right arrow of arrow A1 to eliminate the insertion area 521, to position the resend area 522 at the position of the insertion area 521.

Next the fold correcting processing unit 572 performs the paper currency conveyance process for the deposited paper currency Pm within the resend area 522 (Step S1). In the below, the process of the fold correcting processing unit 572 conveying the deposited paper currency Pm from the resend area 522 to the sensor unit 530*a* shall be termed the "resend process." In the resend process, the fold correcting processing unit 572 conveys the paper currency within the resend area 522 one sheet at a time following the arrow B1 while shifting the separating plate 525 in the direction of the right arrow of arrow A1 to convey said paper currency one sheet at a time to the sensor unit 530*a*. As described above, because the crease of the fold L1 of the deposited paper currency Pm within the resend area 522 is facing upwards, the fold in the deposited paper currency Pm can be expected to be pressed and extended to be straightened out, and thus corrected by the conveyer rollers 55*i* and 552 during the conveyance along the arrow B1. Conversely, the fold may be corrected within the resend area 522. Here the process wherein the fold correcting processing unit 572 convey the deposited paper currency Pm to the resend area 522 (Step Siio) and the resend process together shall be termed the "fold correcting process." If the fold is corrected by the fold correcting process, then it is determined in step 520 in FIG. 9, in the paper currency conveying process, that there is no missing area La, and the deposited paper currency Pm is conveyed to the temporary storage vault 540. If the fold was not corrected, then it is determined by the paper currency conveying process that the paper currency state of the deposited paper currency Pm is a reverse small fold and the deposited paper currency Pm is conveyed to the return area 523 (Step 5108 in FIG. 10).

For paper currency in the reverse small fold state the reason for not performing the fold correcting process is that the reverse small fold state (FIG. 5(*e*)) will be changed into a forward small fold state (FIG. 5 (*d*)) when the fold correcting process is performed, which reduces the likelihood of being able to eliminate the folds during the conveyance.

Given this, if the fold is not corrected by a single fold correcting process, then the fold correcting process is terminated. However, conversely the fold correcting process may be performed repetitively a number of times, or may be repeated until the fold is corrected. Moreover, while the conveyer rollers 551 and 552 were used in the conveying unit, the present invention is not limited thereto, but rather other structures may be used insofar as the paper currency can be conveyed and the fold correcting effect can be anticipated.

If the paper currency conveying process has been performed for all of the paper currency within the resend area 522 (Step 2 in FIG. 9: Yes), then the forward small fold states are erased by the process in Step S4, and because there will be none of this state in the paper currency state memory area 582 (Step S3: No), then processing will advance to Step S5. If there is, in the paper currency state memory area 582, a counterfeit/torn state, a large fold state, or a reverse small fold state (Step S5: Yes), then the return part 573 performs the return process (Step S6). In the return process, specifically, the separating plates 524 through 526 in FIG. 2 are shifted in the direction of the right arrow of arrow A1, to eliminate the insertion area 521 and the resend area 522, to position the return area 523 at the position of the insertion area 521. Given this, the paper currency is returned to the user through opening the insertion/removal opening 510.

Note that the paper currency Pm that has been conveyed to the temporary storage vault 540 is genuine, and so this paper currency Pm is conveyed in the direction opposite of the arrows B4 and B3, along the arrow B2 to be conveyed to and stored in the paper currency storage vault 560.

The ATM 1000 of the aforementioned example of embodiment is able to perform fold correcting processes for correcting folds in the deposited paper currency Pm. Because the folds are corrected automatically, this can reduce the burden on the user in terms of correcting the folds, making it possible to reduce the per-user transaction time, making it possible to reduce the wait time for other users.

In the ATM 1000 in the example of embodiment described above, a process is performed wherein the fold is corrected when it has been determined by a paper currency state determining unit 571 that the deposited paper currency Pm is in a forward small fold state that can be corrected, and thus there is little wasted effort at attempting to correct folds. When it is determined that the fold would be difficult to correct (a reverse small fold state or a large fold state), the deposited paper currency Pm is returned, making it possible to prevent folded deposited paper currency from becoming an obstruction to the stable operation of the ATM 1000.

Note that, in the past, there has been equipment that would detect folded paper currency based on whether or not the external shape of the paper currency and the thickness of the corners of the paper currency were standard, and would handle the paper currency as genuine if it were determined that the paper currency was genuine at a narrow area Na of the folded paper currency (Patent Document 1). However, in this type of determination, there are cases wherein paper currency wherein non-paper currency has been adhered to the corners thereof, such as in altered bank notes, have been handles as genuine paper currency. Moreover, because there are also cases wherein the thicknesses are not uniform, by design, depending on the paper currency, in foreign paper currency, etc., wherein this type of determination method often produces inaccurate determination results. Because the ATM 1000 in the present example of embodiment is provided with multiple sensors of multiple types, it is possible to obtain more detailed characteristic data, making it possible to perform the genuine/counterfeit determination more accurately. Because paper currency in the counterfeit/torn state is returned, it is possible to prevent counterfeit or altered notes from becoming an impediment to the stable operation of the ATM 1000.

Other examples of embodiment:

(1) While in the example of embodiment described above, all paper currency in the counterfeit/torn state or the large fold state, or the reverse small fold state were all returned to the user in the same manner, conversely, different processes may be performed for each.

Figure 12:
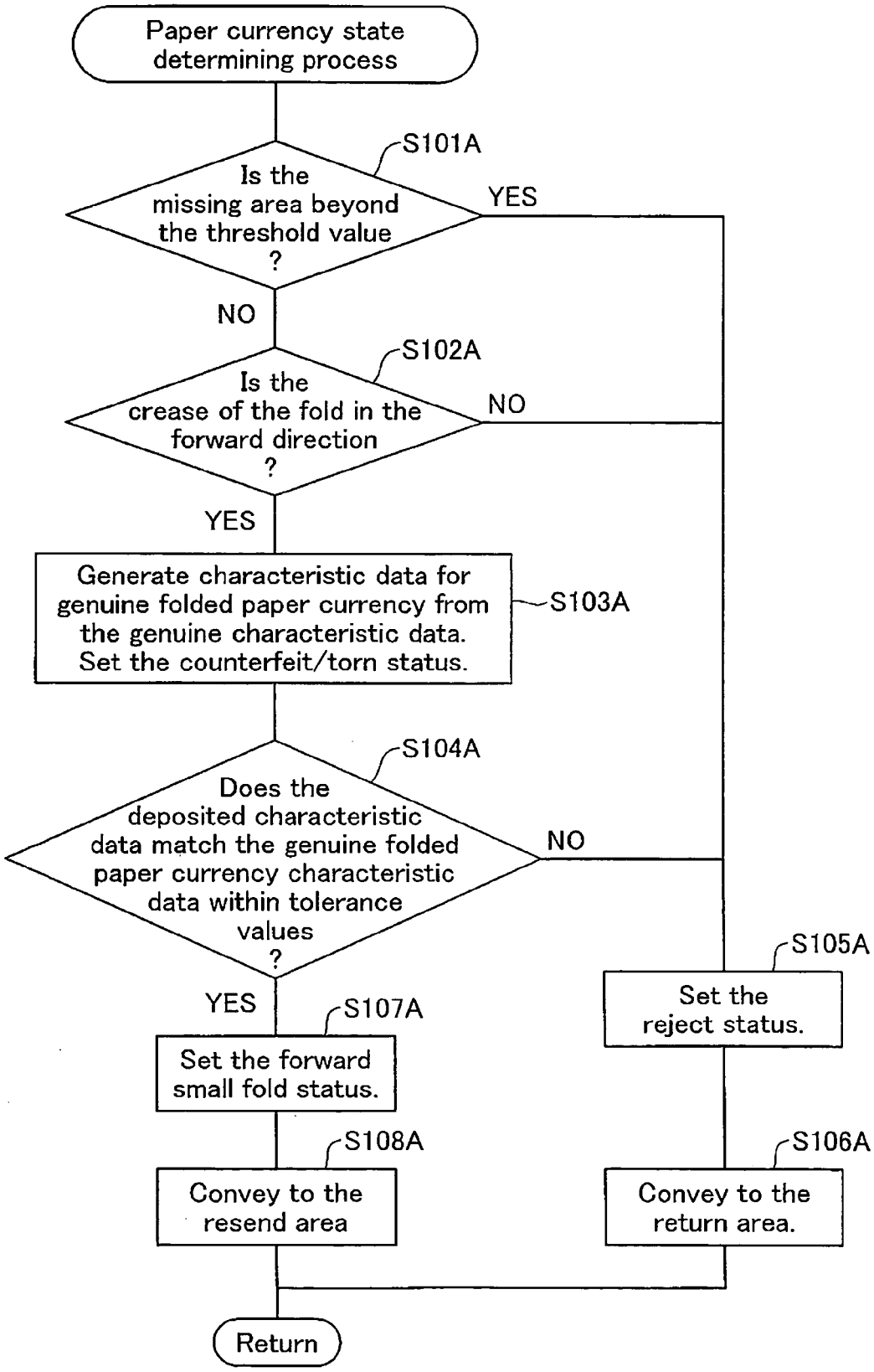
FIG. 12 is a flow chart illustrating the paper currency state determining process when rejection and classification is performed in the same way.

(2) While in the example of embodiment described above, the paper currency states were categorized into the counterfeit/torn state, the large fold state, the reverse small fold state, and the forward small fold state; however, the method of categorizing is not limited thereto, and other categories may be added or a portion thereof may be omitted. For example, the counterfeit/torn state, large fold state, and reverse small fold state, may all be categorized as a "reject state," where the deposited paper currency Pm is returned if in the reject state. FIG. 12 is a flow chart illustrating the paper currency state determining process when all are categorized as "reject." The difference from the paper currency state determining process of FIG. 10 is that the determination as to whether or not the deposited paper currency Pm is genuine folded paper currency is performed after the determination of whether or not the folded area La exceeds the threshold value B1 and the determination as to whether or not the crease of the fold L1 is in the forwards direction (Step S103*a* and 104*a*). Moreover, paper currency to which the forward small fold state does not apply is all determined to be of the reject state (Steps S101*a*, S102*a*, and S105*a*). In this way, if paper currency of a reject state is inserted, no decision is performed as to whether or not the paper currency is genuine folded currency, which makes it possible to reduce the processing time. In this way, the processing in the paper currency state determining process can be eliminated in part, and the sequence of processes may also be modified.

(3) In the example of embodiment described above, if not all of the data for the deposited currency data and the genuine folded paper currency characteristic data matched within a tolerance range established in advance, then it was determined that the paper currency was not genuine folded paper currency; however, the decision may be made based on one or more of these types of data: image data, magnetic data, and thickness data. In this case, not all types of sensors need be provided in the sensor unit.

(4) In the example of embodiment described above, the direction of conveyance of the paper currency was reversed by conveying the deposited paper currency Pm to the resend area 522; however, the method of reversing the direction of conveyance is not limited thereto, but rather a variety of methods may be envisioned. Mechanically turning around the direction of conveyance during the conveyance in the conveying unit 550 is also possible.

Figure 13:
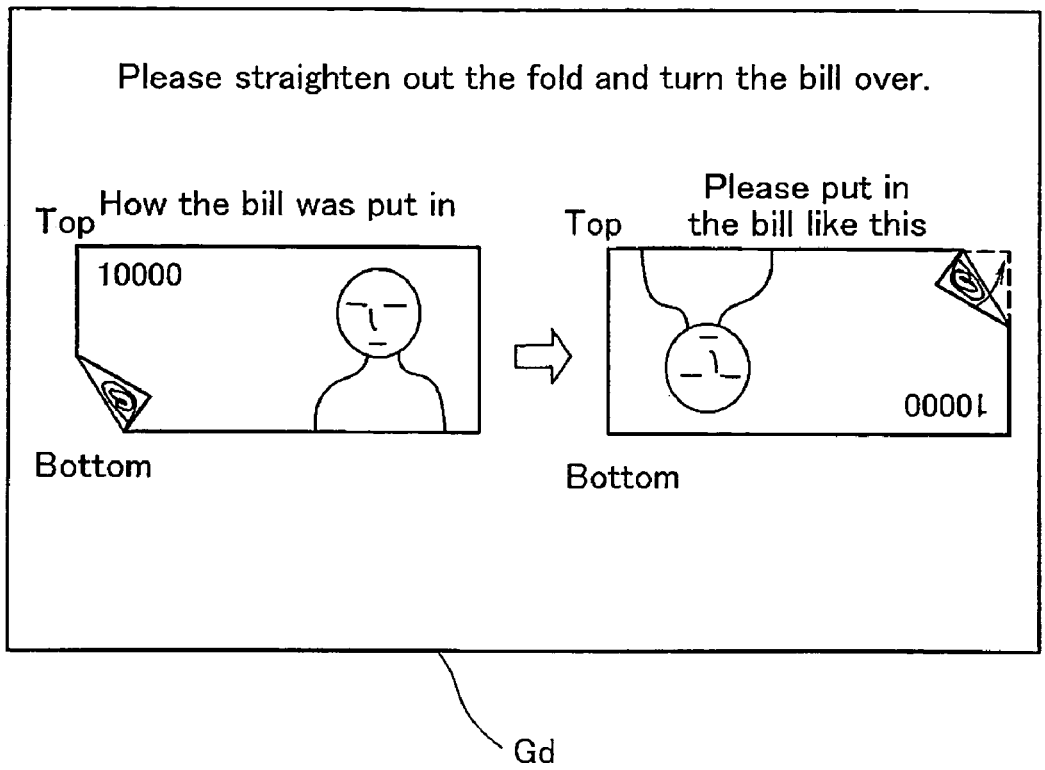
FIG. 13 is an explanatory diagram illustrating guidance Gd.

(5) The fold correcting process is not limited to that which was illustrated in the example of embodiment, described above, but rather there are a variety of processes. For example, the fold correcting processing unit 572 may return to the user any deposited paper currency Pm in the forward small fold state and may display guidance Gd, such as shown in FIG. 13, on the display/operating unit 100. With the guidance, the user is instructed on how to correct the fold in such a manner that it would be unlikely that the fold would occur again in the deposited paper currency Pm. Given this, the fold correcting processing unit 572 resends the inserted paper currency. This fold correcting process may be defined as the fold correcting. In this case, the display/operating unit 100 corresponds to the fold correcting processing unit according to the present invention. Given this, it is possible for the user to correct the fold because the deposited paper currency Pm is returned to the user. Even if the user does not correct the fold, if the paper currency is reinserted in the orientation indicated by the guidance Gd, it will be possible for the fold in the deposited paper currency Pm to be corrected.

The image of the paper currency displayed in the guidance Gd of FIG. 13 may be displayed based on the deposited paper currency characteristic data, and, in particular, displayed based on the deposited paper currency image data. When the image data acquiring unit for acquiring image data of the deposited paper currency Pm is provided separately from the sensor unit 530, an image of the deposited paper currency Pm may be displayed based on the image data acquired by the image data acquiring unit. When the image of the deposited paper currency Pm is displayed, the user is notified of the state, within the ATM 1000, of the paper currency inserted by the user, making it possible to display the guidance Gd in a more compelling way. As shown in FIG. 13, the image of the deposited paper currency Pm may be used even in an image for instructing regarding the direction for inserting the paper currency.

(6) In the example of embodiment described above, the determination of whether or not the fold has been corrected by the fold correcting process was performed based on the deposited characteristic data read out by the sensor unit 530*a* however, a separate sensor may be provided instead of the sensor unit 530*a*, and the determination may be performed on the output of that sensor.

(7) In the example of embodiment described above, deposited paper currency Pm aside from genuine paper currency was conveyed directly to the resend area 522 or the return area 523; however, the deposited paper currency Pm that is not genuine paper currency may be conveyed to the resend area 522 or the return area 523 after storage in the temporary storage vault.

Figure 14:
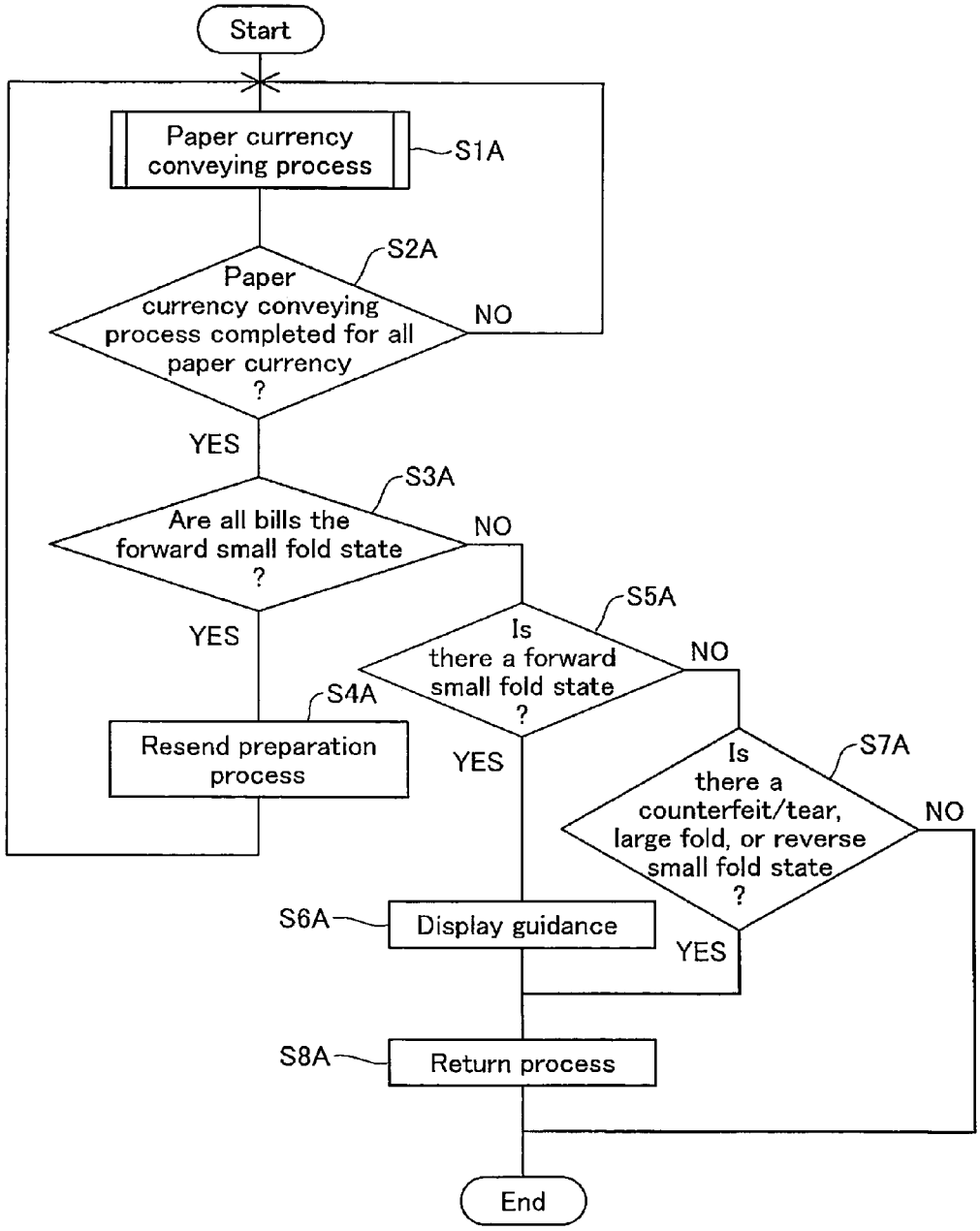
FIG. 14 is a flow chart illustrating the process for the ATM 1000 when provided with a resend/return area.

(8) In the example of embodiment described above, the resend area 522 and the return area 523 are divided by a separating plate 525, and are provided separately; however, rather than providing a separating plate 525, the resend area 522 and the return area 523 may be integrated. This integrated area shall be termed the "return/resend area," below. FIG. 14 is a flowchart illustrating the process in the ATM 1000 when provided with a return/resend area. Steps S1A and S2A are the same as Steps S1 and S2 in FIG. 8. In Step S3A, if the paper currency state of the paper currency state memory area 582 is a forward small fold state, a resend preparation process is performed (Step S4A), and all of the paper currency within the resend/return area is resent and processed. If there is paper currency of the forward small fold state (State S5A: Yes), then even if there is no forward small fold state for all of the paper currency states (State S3A: No), then the guidance of FIG. 13 is displayed (Step S6A), and all of the paper currency within the resend/return area is returned to the user (Step S7A). In this case, the guidance in Step 13 may provide a display indicating which of the bills in the resend/return area should be turned around, based on the contents of the paper currency state memory area 582. If there is no paper currency in the forward small fold state (Step S5A: No) and paper currency in the counterfeit/torn state, the large fold state, or the reverse small fold state (Step S7A: Yes), then the paper currency in the resend/return area is returned to the user (Step S8*a*).

While omitted in the description of the example embodiment described above, the paper currency handling apparatus control unit of 570 searches the genuine characteristic database of 503 in FIG. 7 using the deposited paper currency characteristic data in Step S10 in FIG. 9, and if there is no genuine characteristic data corresponding to the deposited paper currency characteristic data, then the deposited paper currency Pm may be conveyed to the return area 523 as being in the counterfeit/torn state.

Figure 15A:
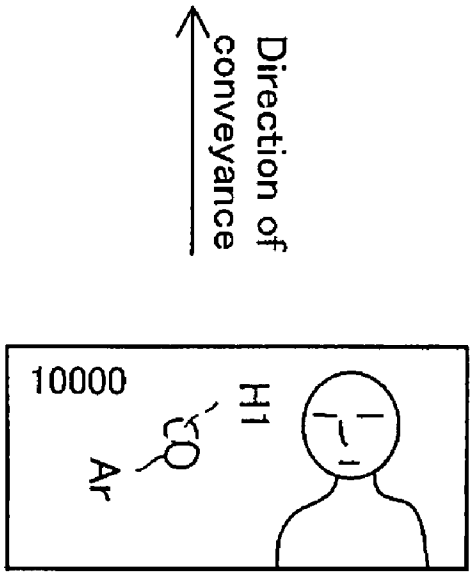
FIG. 15 is an explanatory diagram illustrating a torn paper currency.
Figure 15B:
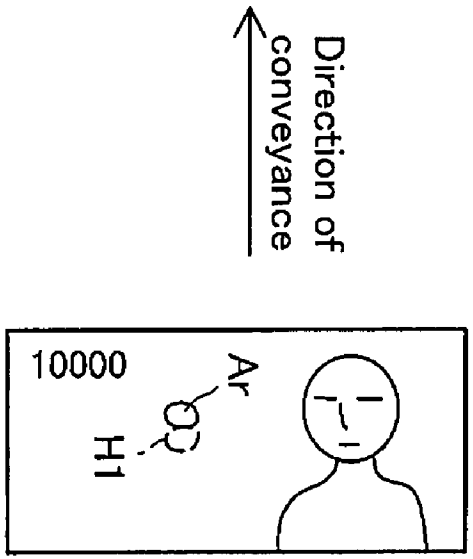

(10) In the example of embodiment described above, there was an explanation of a dog-eared paper currency were, primarily, the corner of the paper currency is folded, as being the folded paper currency; however, as shown in FIG. 15 (*a*) and (*b*), is folded paper currency includes torn paper currency were in there is a portion that is torn, and the torn portion Ar is folded. In this case, the determination as to whether or not the fold is large is made based on the size of the hole H1 that results from the tear in the paper currency. If the size of the hole H1 is less than a threshold value, then it is determined that the paper currency state in FIG. 13 (*a*) is a forward small fold state, or the paper currency state in FIG. 13 (*b*) is determined to be a reverse small fold state.

(11) In the example of embodiment described above, the paper currency handling apparatus control unit 570 and the paper currency handling apparatus memory unit 580 were provided within the paper currency handling apparatus 500; however, at least portion thereof may be provided within the paper currency discriminating apparatus 530. For example, a paper currency state determining unit 571 and a genuine characteristic database 583 may be provided in a paper currency discriminating unit 530, where the paper currency discriminating unit 530 may be structured as a paper currency discriminating apparatus. Conversely, at least portion of the paper currency handling apparatus control unit 570 and the paper currency handling apparatus memory unit 580 may also be provided within a control unit 700 or a memory unit 600 for the ATM 1000. A variety of different structures is possible.

(12) In the example of embodiment described above, whether or not the deposited paper currency Pm is genuine folded currency was determined based on producing genuine folded currency characteristic data; however, the method of determining whether or not the deposited paper currency Pm is genuine folded paper currency is not limited thereto, but a variety of different methods may be used.

(13) In the example of embodiment described above, paper currency of a counterfeit/torn state, a large fold state, or a reverse small fold state was returned to the user; however, a reject box may be provided and this paper currency may be placed in the reject box. In this case, instead of paper currency in the large fold state or the reverse small fold state, paper currency that is not for the may be returned to the user.

(14) In the example of embodiment described above, a fold correcting process was performed only on the deposited paper currency Pm in the forward small fold state; however, the fold correcting process may be performed regardless of the state of the paper currency. Furthermore, the fold correcting process may be performed regardless of whether or not there exists a missing area La. Conversely, after the fold correcting process has been performed one or more times, and a determination is made as to whether or not there is a missing area La, the paper currency may be returned to the user if there is still a missing area La, but if it is determined that there is no missing area, then Steps S30-S70 may be performed. When this is done, the fold correcting process is performed depending on whether or not there is a missing area La in the deposited paper currency, or performed regardless of the state of the deposited paper currency Pm, and thus it is possible to eliminate the decision as to whether or not there is a missing area La in the deposited paper currency Pm and the determination of the state of the paper currency, making it possible to correcting the fold, using the fold correcting process, if there is a fold. This makes it possible to reduce the time for the user when inserting folded paper currency.

(15) In the example of embodiment described above, the explanation was for an ATM 1000 as the apparatus; however, the apparatus is not limited to the ATM 1000, but rather may be an automatic cash payment machine (a cash dispenser), an automatic transaction apparatus such as a ticket vending machine, a paper currency handling apparatus 500, or another apparatus having paper currency handling functions.

While the apparatus, method, paper currency discriminating apparatus, and programs for achieving these functions for the present invention have been described based on an example of embodiment, above, the forms of embodiment of the present invention, described above, are simply to facilitate an understanding of the invention, and in no wise limit the present invention. The present invention may be modified or change without deviating from the spirit or scope of patent claims of the present invention, and such modifications and changes are, of course, included as equivalent to the present invention.

The invention claimed is:

1. An apparatus for processing paper currency, comprising:

a sensor unit that acquires deposited paper currency characteristic data indicating characteristics of deposited paper currency by reading characteristics of the deposited paper currency;

a conveying unit that conveys deposited paper currency in a conveying direction;

a folded paper currency determining unit that determines if the deposited paper currency is a folded paper currency based on a detection of a missing area in the deposited paper currency, in response to the deposited paper currency characteristic data, the folded paper currency having a folded portion; and a fold correcting processing unit that executes a fold correcting process for correcting the fold in the deposited paper currency in response to the determination that the deposited paper currency is the folded paper currency by changing an orientation of the deposited paper currency with respect to the conveying direction and providing the deposited paper currency having a changed orientation to the conveying unit to return the deposited paper currency to the sensor unit.

2. The apparatus according claim 1, further comprising a determining unit that determines if the correction is possible based on the deposited characteristic data when the deposited paper currency is the folded paper currency, wherein the fold correcting process is executed only if the determining unit determines that the correction is possible.

3. The apparatus according claim 2, comprising:

the determining unit determines if the correction is possible based on a direction of a crease of the fold, the correction being determined possible when the crease of the fold faces the same direction as the conveying direction.

4. The apparatus according claim 2, wherein the determining unit determines if the correction is possible based on a size of the missing area, the correction being determined possible when the crease of the fold faces the same direction as the conveying direction when the size of the missing area is no more than a predetermined threshold value.

5. The apparatus according claim 2, wherein the fold correcting processing unit further comprises a returning unit that returns the deposited paper currency if the determining unit determines that the correction is impossible.

6. The apparatus according claim 1, further comprising:

a memory unit that stores genuine characteristic data indicating characteristics of genuine paper currency; and a genuine determining unit that determines if the deposited paper currency is folded genuine paper currency, based on the deposited paper currency characteristic data and one set of genuine characteristic data, wherein the fold correcting process is executed only when the deposited paper currency is folded genuine paper currency.

7. The apparatus according claim 6, wherein the genuine determining unit determines if the deposited paper currency is the folded genuine paper currency by comparing the deposited paper currency characteristic data and characteristic data generated by producing the missing area in the genuine paper currency based on the genuine characteristic data.

8. The apparatus according claim 1, wherein the characteristics include at least one of the following:

design of the paper currency;

magnetism added to the paper currency; and thickness of the paper currency.

9. The apparatus according claim 1, wherein the folded paper currency is dog-eared paper currency in which a corner of the paper currency is folded, or is torn paper currency in which a portion of the folded paper currency is torn and folded.

10. The apparatus according claim 1, wherein the folded paper currency determining unit is configured to redetermine if returned deposited paper currency is the folded paper currency.

11. The apparatus according to claim 1, wherein the deposited paper currency is conveyed in only one conveying direction.

12. A paper currency discriminating apparatus for discriminating paper currency, comprising:

a memory unit that stores genuine characteristic data indicating characteristics of genuine paper currency; and a sensor unit that acquires deposited paper currency characteristic data by reading characteristics of the deposited paper currency;

a folded paper currency determining unit that determines if the deposited paper is a folded paper currency based on a detection of a missing area in the deposited paper currency, in response to the reading of the deposited paper currency characteristic data, the folded paper currency having a folded portion;

a genuine paper currency determining unit that determines if the deposited paper currency is folded genuine paper currency, the determination being made by comparing the deposited paper currency characteristic data with genuine paper currency characteristic data generated by producing folded part image data from the genuine paper currency characteristic data to an overlaid area, wherein the overlaid area is produced by overlaying the folded part image data of a reverse side of the genuine paper currency characteristic data onto the folded paper currency.

13. A method of processing paper currency, comprising:

conveying deposited paper currency in a conveying direction;

acquiring deposited paper currency characteristic data indicating characteristics of the deposited paper currency by reading characteristics of the deposited paper currency by a sensor;

determining by a computer if the deposited paper is a folded paper currency based on a detection of a missing area in the deposited paper currency, in response to the deposited paper currency characteristic data, the folded paper currency having a folded portion; and executing a fold correcting process for correcting the fold in the deposited paper currency in response to the determination by the computer that the deposited paper is the folded paper currency by changing an orientation of the deposited paper currency with respect to the conveying direction and conveying the deposited paper currency having a changed orientation in the conveying direction.

14. A method of processing paper currency according to claim 13, further comprising:

after executing the fold correcting process, reacquiring the deposited paper currency characteristic data from the deposited paper currency for a redetermination and executing the redetermination.

15. The method according claim 13, further comprising determining if the correction is possible based on the deposited characteristic data when the deposited paper currency is the folded paper currency, wherein the fold correcting process is executed only if it is determined that the correction is possible.

16. The method according claim 15, comprising:

determining if the correction is possible is based on a direction of a crease of the fold, the correction being determined possible when the crease of the fold faces the same direction as the conveying direction.

17. The method according claim 15, wherein determining if the correction is possible is based on a size of the missing area, the correction being determined possible when the crease of the fold faces the same direction as the conveying direction when the size of the missing area is no more than a predetermined threshold value.

18. A paper currency handling apparatus, comprising:

a conveying unit that conveys deposited paper currency in a conveying a receiving unit that receives paper currency deposited by a user;

a genuine determining unit that reads characteristics of the paper currency deposited from the sensing unit, acquires deposited paper currency characteristic data indicating characteristics of the deposited paper currency, determines if the deposited paper currency is genuine paper currency or counterfeit paper currency, and determines if the deposited paper is a folded paper currency having a folded portion, based on the deposited paper currency characteristic data; and a fold correcting processing unit that executes a fold correcting process for correcting the fold in the deposited paper currency and returns the corrected paper to the genuine determining unit to redetermine if the deposited paper currency is a folded paper currency, in response to the determination that the deposited paper is a genuine and folded paper currency by changing an orientation of the deposited paper currency with respect to the conveying direction and providing the deposited paper currency having a changed orientation to the conveying unit to return the deposited rarer currency to the sensor unit.

* * * * *